US011098562B2

(12) United States Patent
Box et al.

(10) Patent No.: US 11,098,562 B2
(45) Date of Patent: Aug. 24, 2021

(54) END PROTECTORS FOR JET PERFORATING GUNS

(71) Applicant: Halliburton Energy Services, Inc., Houston, TX (US)

(72) Inventors: Lewis Douglas Box, Mansfield, TX (US); Marie Orpah Mills, Alvarado, TX (US); Christopher C. Hoelscher, Arlington, TX (US); Nicholas G. Harrington, Midlothian, TX (US); Armando Duputel, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 230 days.

(21) Appl. No.: 16/339,343

(22) PCT Filed: Dec. 12, 2017

(86) PCT No.: PCT/US2017/065771
§ 371 (c)(1),
(2) Date: Apr. 3, 2019

(87) PCT Pub. No.: WO2019/117861
PCT Pub. Date: Jun. 20, 2019

(65) Prior Publication Data
US 2021/0079767 A1 Mar. 18, 2021

(51) Int. Cl.
*E21B 43/119* (2006.01)
*E21B 43/116* (2006.01)

(52) U.S. Cl.
CPC ..... *E21B 43/119* (2013.01); *E21B 43/116* (2013.01)

(58) Field of Classification Search
CPC .... E21B 43/116; E21B 43/117; E21B 43/118; E21B 43/119
(Continued)

(56) References Cited

U.S. PATENT DOCUMENTS 1,607,430 A * 11/1926 Brewster ..... E21B 33/03 166/75.11
2,627,877 A * 2/1953 Phillips ..... F16L 57/005 138/96 T
(Continued)

FOREIGN PATENT DOCUMENTS

WO 2013162490 A1 10/2013

OTHER PUBLICATIONS

International Search Report and Written Opinion for corresponding application No. PCT/US2017/065771; dated Sep. 6, 2018; 14 pages.
(Continued)

*Primary Examiner* — John Cooper
(74) *Attorney, Agent, or Firm* — McGuireWoods LLP

(57) ABSTRACT

Perforating gun end protectors including pin end protectors and box end protectors include both a polymer component and a metal component. The pin end protectors and box end protectors herein meet packaging and shipping regulations for shipping perforating gun protectors having charges installed. The pin end protectors and box end protectors of the disclosure are less costly, reduces overall weight, and provide additional safety benefits as compared to traditional metal pin end protectors and metal box end protectors. The polymer component is configured to melt in a deflagration situation thereby venting of the perforating gun to prevent pressure build-up.

16 Claims, 12 Drawing Sheets

(58) Field of Classification Search
USPC ..... 89/1.15, 1.151
See application file for complete search history.

(56) References Cited

U.S. PATENT DOCUMENTS

| | | | | |
|---|---|---|---|---|
| 4,139,005 | A | 2/1979 | Dickey | |
| 4,157,100 | A * | 6/1979 | Turk | F16L 57/005 138/96 R |
| 4,487,228 | A * | 12/1984 | Waldo | B65D 59/02 138/89 |
| 4,534,423 | A * | 8/1985 | Regalbuto | F42B 3/08 166/297 |
| 6,474,411 | B1 * | 11/2002 | Carrano Castro | B65D 59/02 166/241.7 |
| 8,746,331 | B2 * | 6/2014 | Kash | E21B 43/119 166/55 |
| 9,051,817 | B2 | 6/2015 | Hales et al. | |
| 10,487,594 | B2 * | 11/2019 | Aguilar Mendez | F16L 57/005 |
| 2004/0200525 | A1 | 10/2004 | Goodson et al. | |
| 2008/0307951 | A1 | 12/2008 | Kaiser et al. | |
| 2013/0037255 | A1 | 2/2013 | Kash et al. | |
| 2013/0220614 | A1 | 8/2013 | Torres et al. | |
| 2017/0298715 | A1 | 10/2017 | McConnell et al. | |
| 2019/0040722 | A1 * | 2/2019 | Yang | E21B 43/117 |
| 2019/0153827 | A1 * | 5/2019 | Goyeneche | E21B 17/028 |

OTHER PUBLICATIONS

Search Report issued in French Application No. 1858718 by the French Patent Office dated Sep. 3, 2019.

Revata: "Plastic Thread Protectors Steel Thread Protectors Packing Frames for Drill Pipes, Tubings, & Casings Flange Protectors Pipe Caps"; www.revataengineering.com/brochures/thread-prortectors.pdf; Oct. 24, 2009 (pp. 1-18).

Anonymous: "Interpretation Response PHMSA"; www.phamsa.dot.gov/regulations/title49/interp/17-0043; Nov. 14, 2017 (pp. 1-3).

* cited by examiner

END PROTECTORS FOR JET PERFORATING GUNS

TECHNICAL FIELD

This disclosure relates, in general, to equipment utilized in conjunction with operations performed in subterranean production and injection wells and, in particular, to end protectors for protecting ends of jet perforating guns.

BACKGROUND

Without limiting the scope of the present disclosure, its background will be described with reference to transporting equipment that is used for producing fluid from a hydrocarbon bearing subterranean formation, as an example.

During the completion of a well that traverses a hydrocarbon bearing subterranean formation, perforating guns or strings of perforating guns are commonly used to facilitate extracting energy resources from the subterranean formation. Perforating guns may be lowered into a well to cause and control subterranean explosions to horizontally broaden vertical well bores or broaden horizontal well bores. Perforating guns may be strung together to create a string of perforating guns.

Transporting of perforating guns having shaped charges installed are regulated by the governmental standards and generally require a metal type end cap, protector or cover to protect the ends of the perforating guns during shipment. Perforating guns that do not have shaped charges installed do not require a metal end cap when shipped.

Accordingly, a need has arisen for reducing material costs of end protectors used during shipping of perforating guns having shaped charges installed, while still meeting and complying with governmental safety standards, such as packing instruction US 1 (49 CFR § 173.62) for transporting perforating guns having shaped charges installed.

BRIEF DESCRIPTION OF THE DRAWINGS

For a more complete understanding of the features and advantage of the present disclosure, reference is now made to the detailed description along with the accompanying figures in which corresponding numerals in the different figures refer to corresponding parts and in which.

Figure 2A:
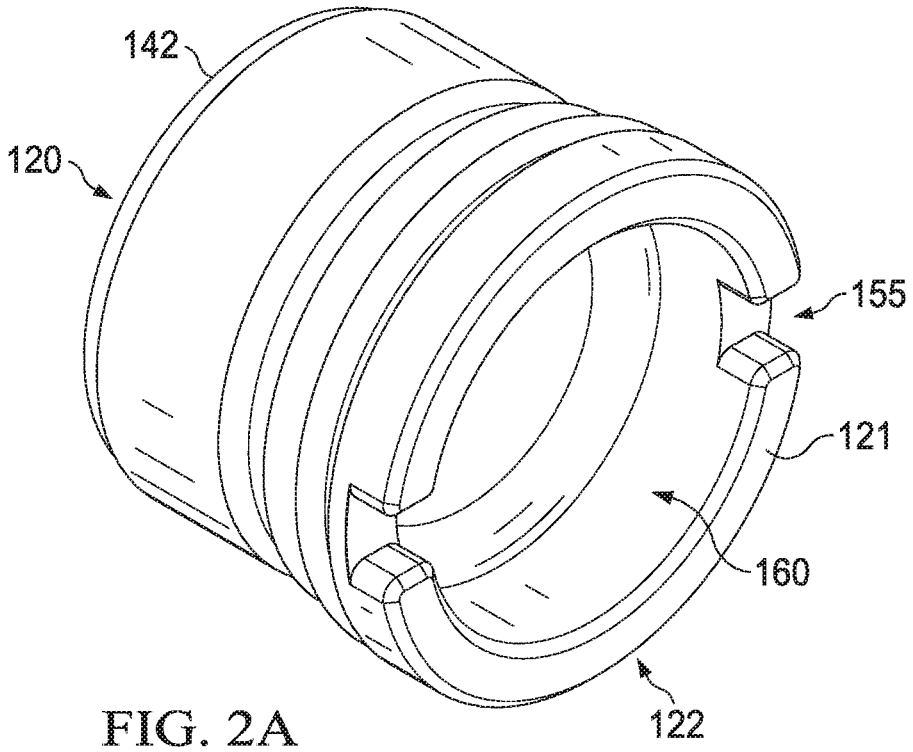
FIG. 2A is a perspective view of a box end protector according to an embodiment of the present disclosure.
Figure 2B:
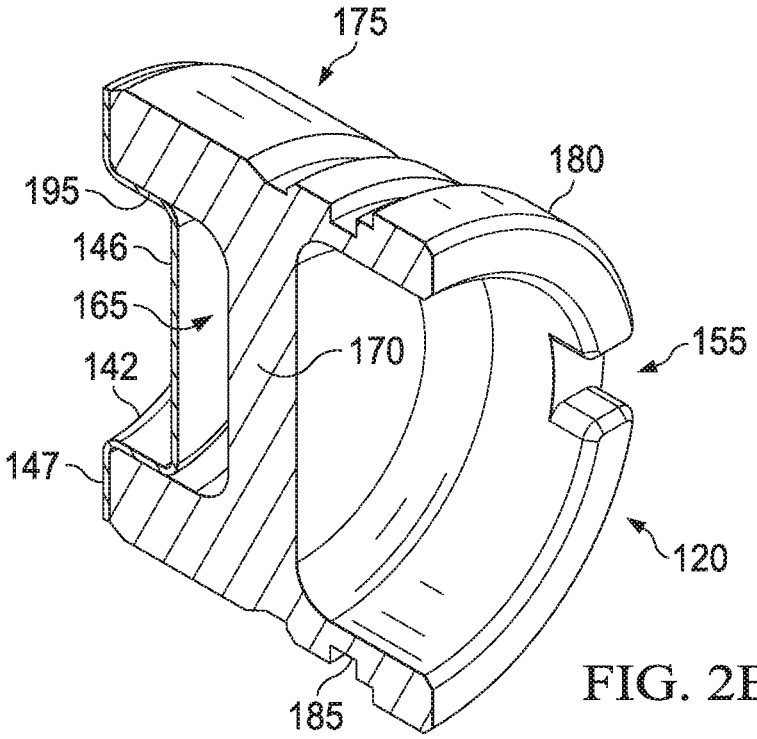
FIG. 2B is a cross-sectional view of FIG. 2A.
Figure 2D:
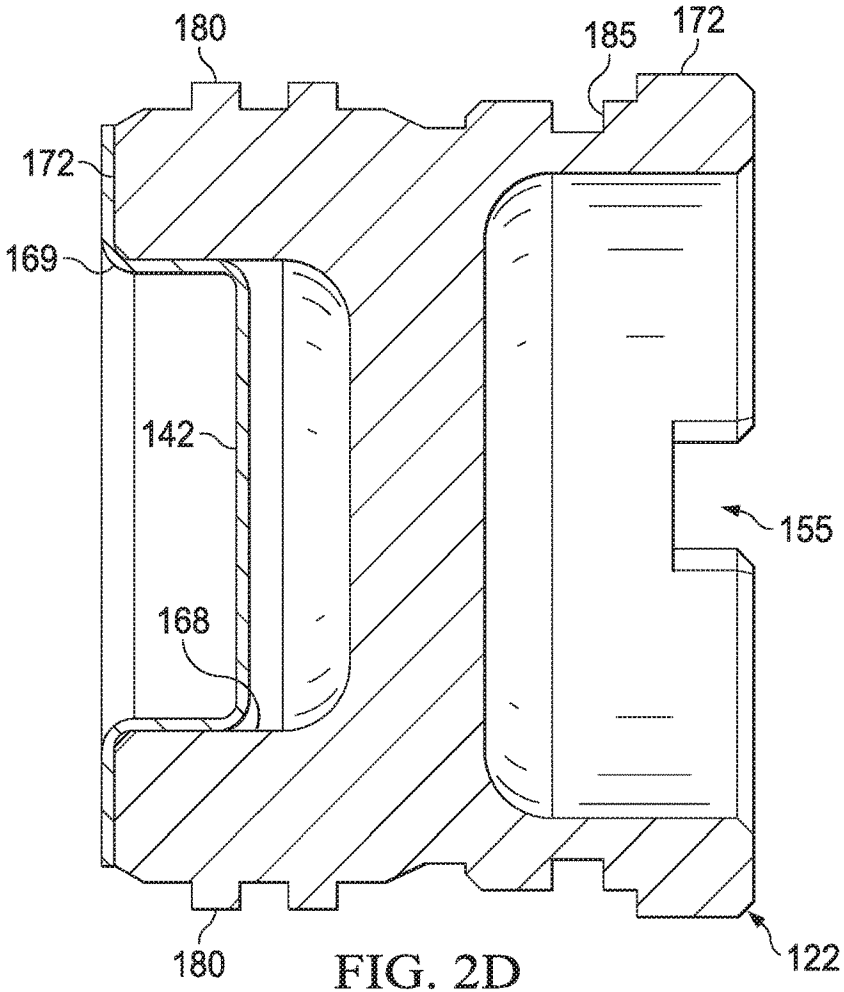
FIG. 2C is a cross-sectional view of FIG. 2A, showing additional detail.
Figure 2C:
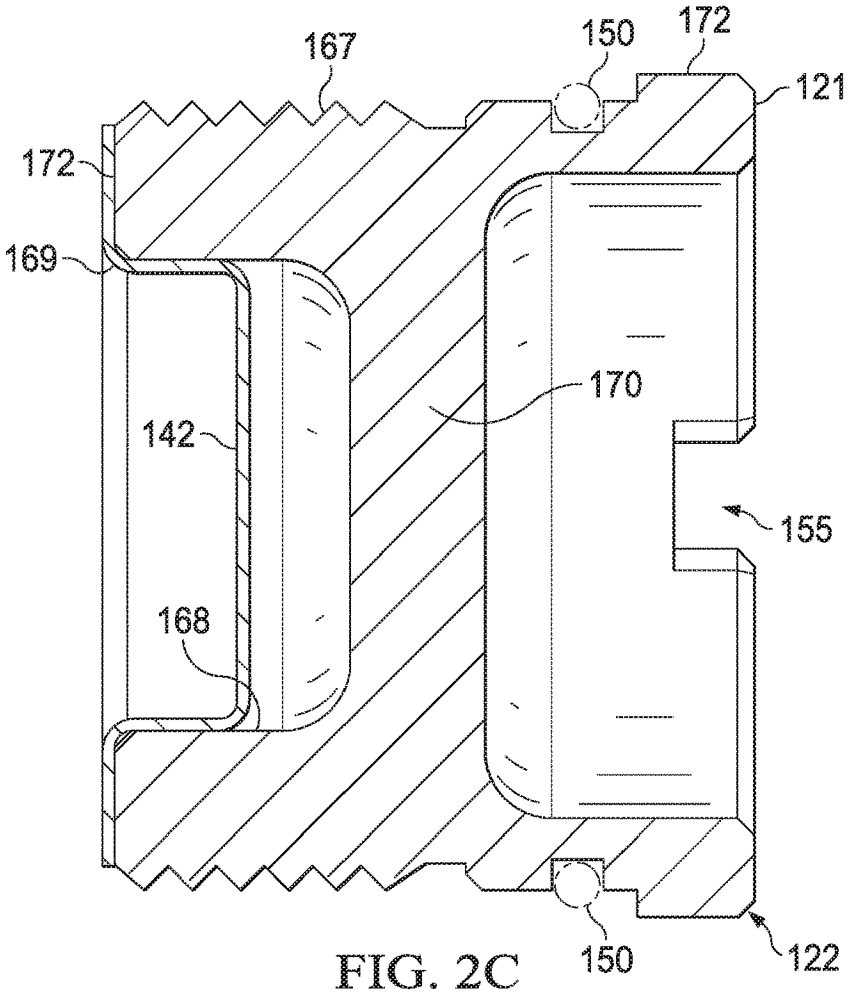
Figure 2E:
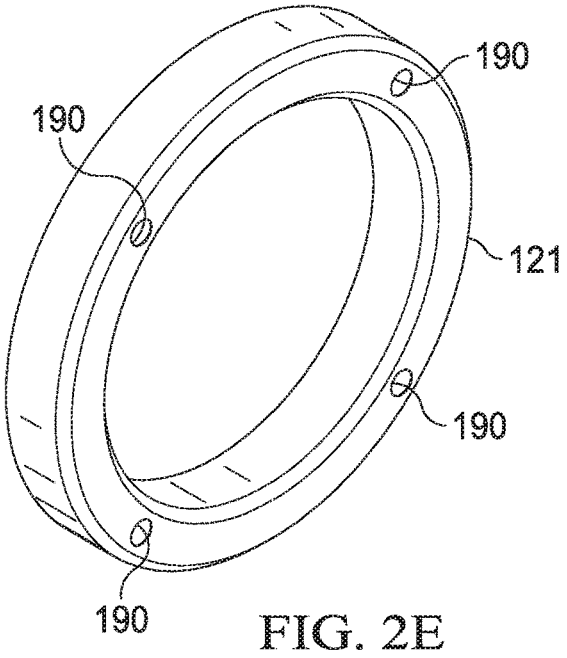
Figure 2F:
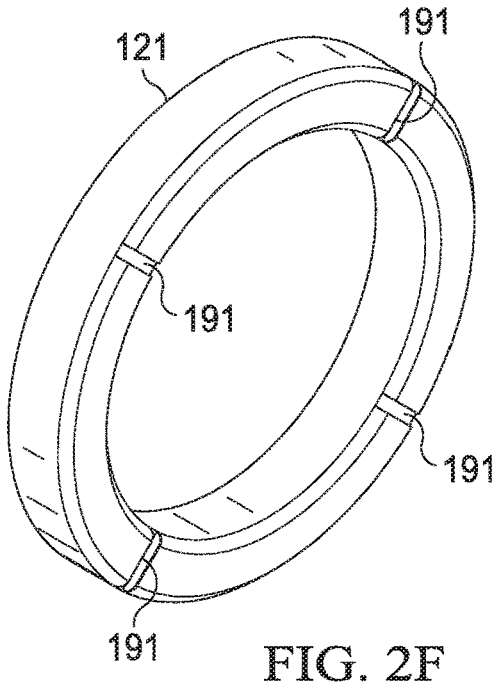
Figure 2G:
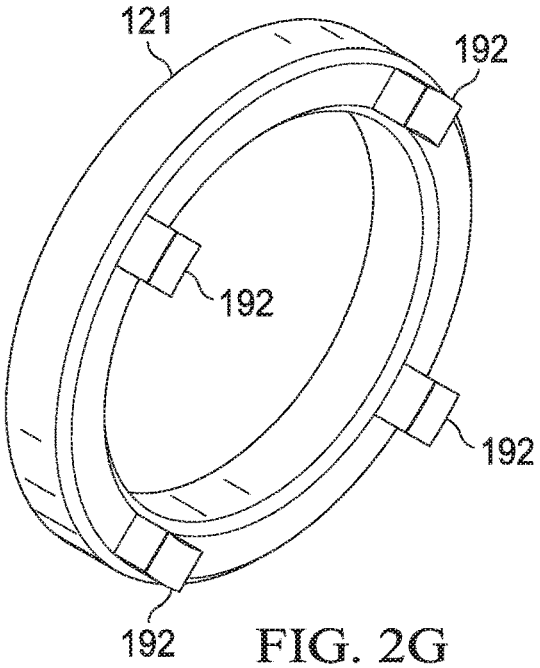
Figure 3A:
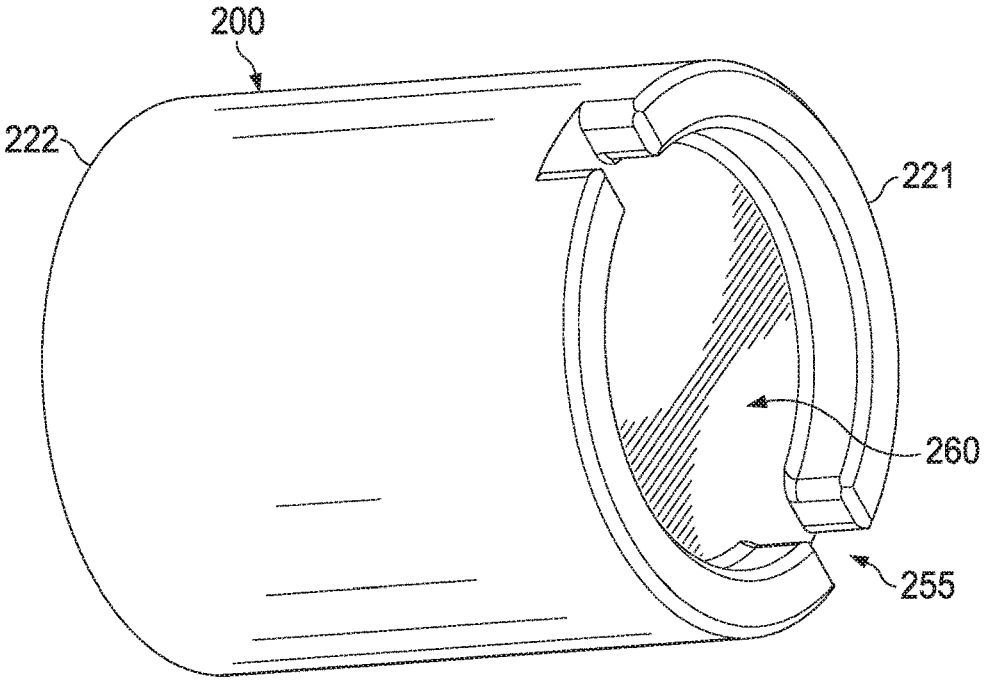
Figure 3B:
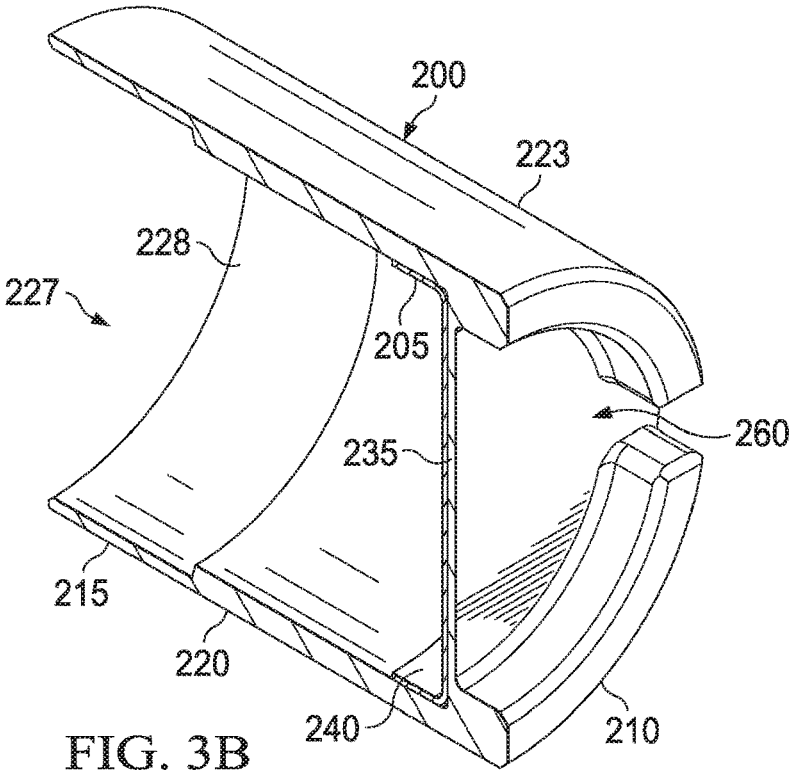
Figure 3C:
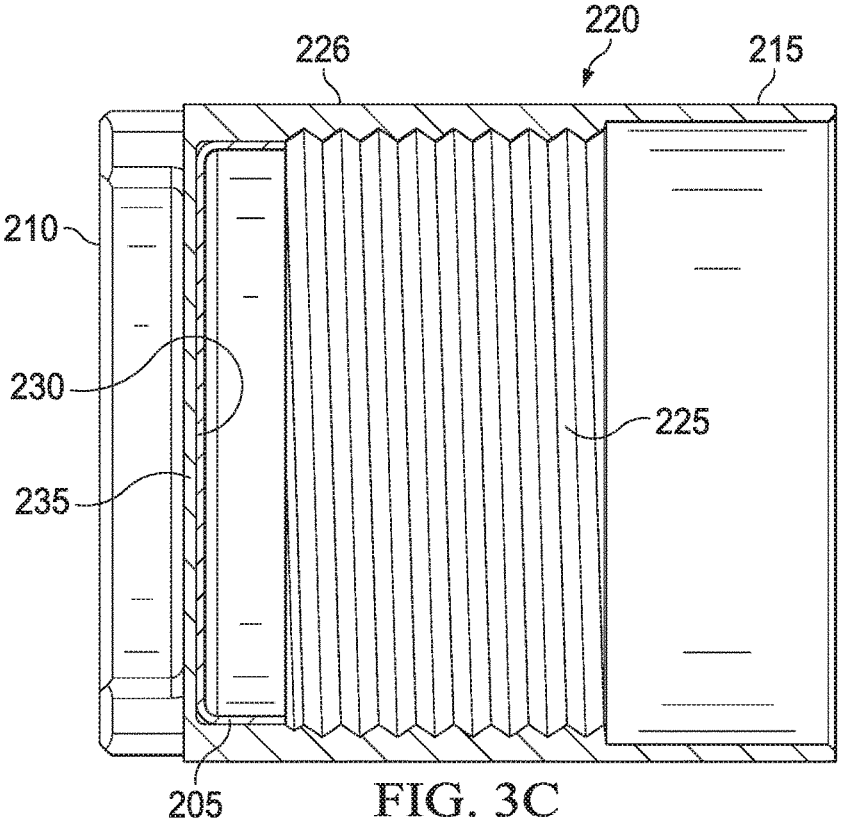
Figure 3D:
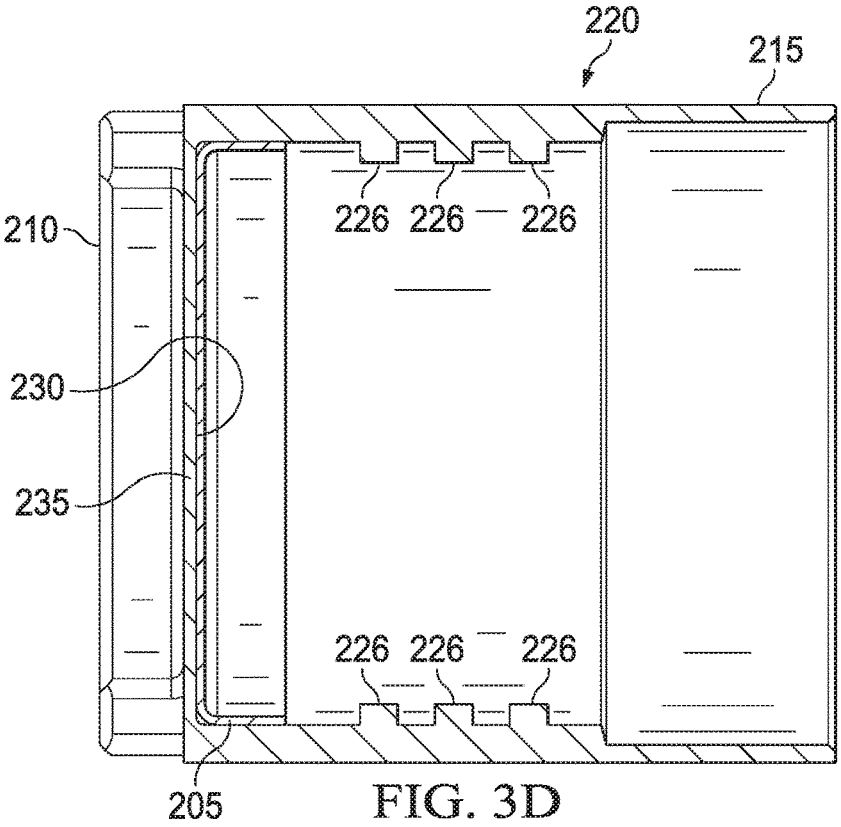
Figure 3E:
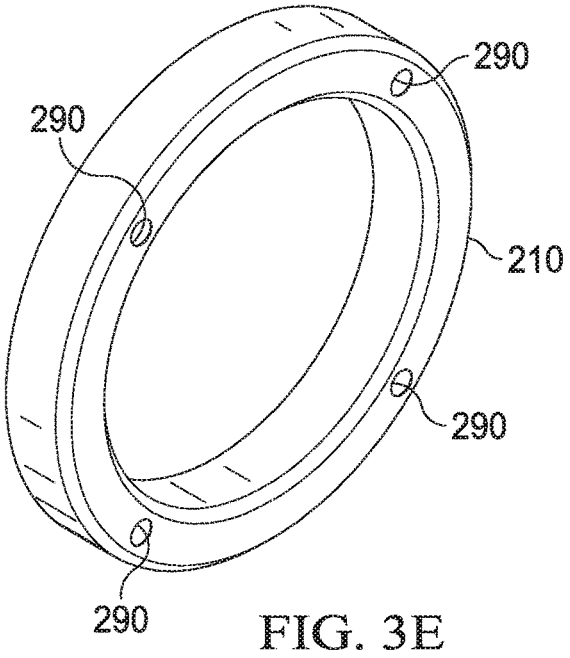
Figure 3F:
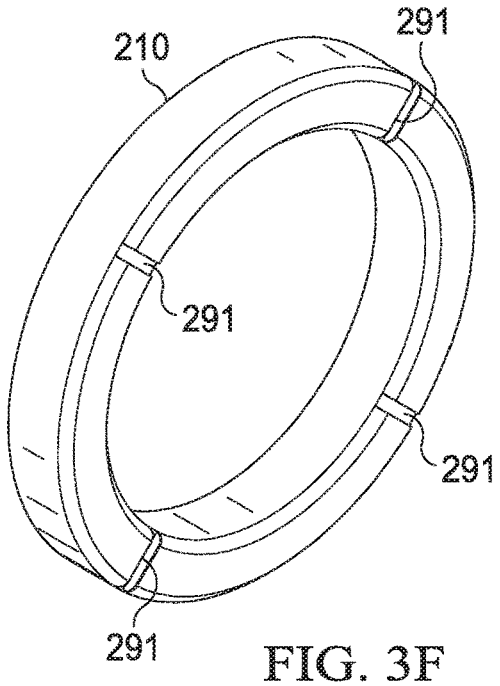
Figure 3G:
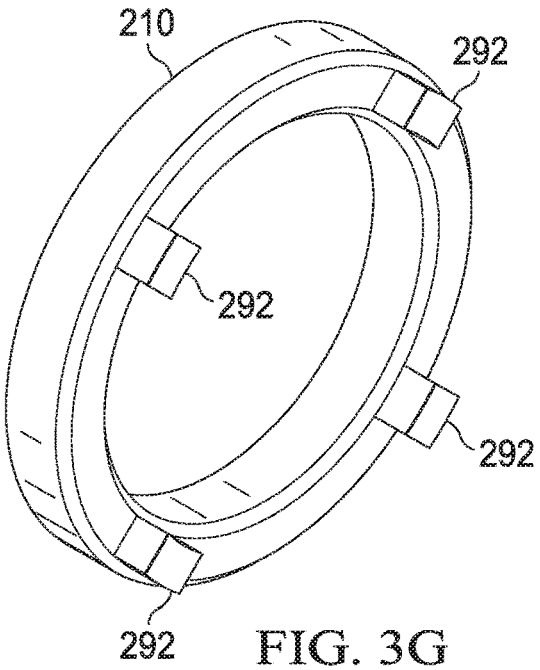
Figure 5:
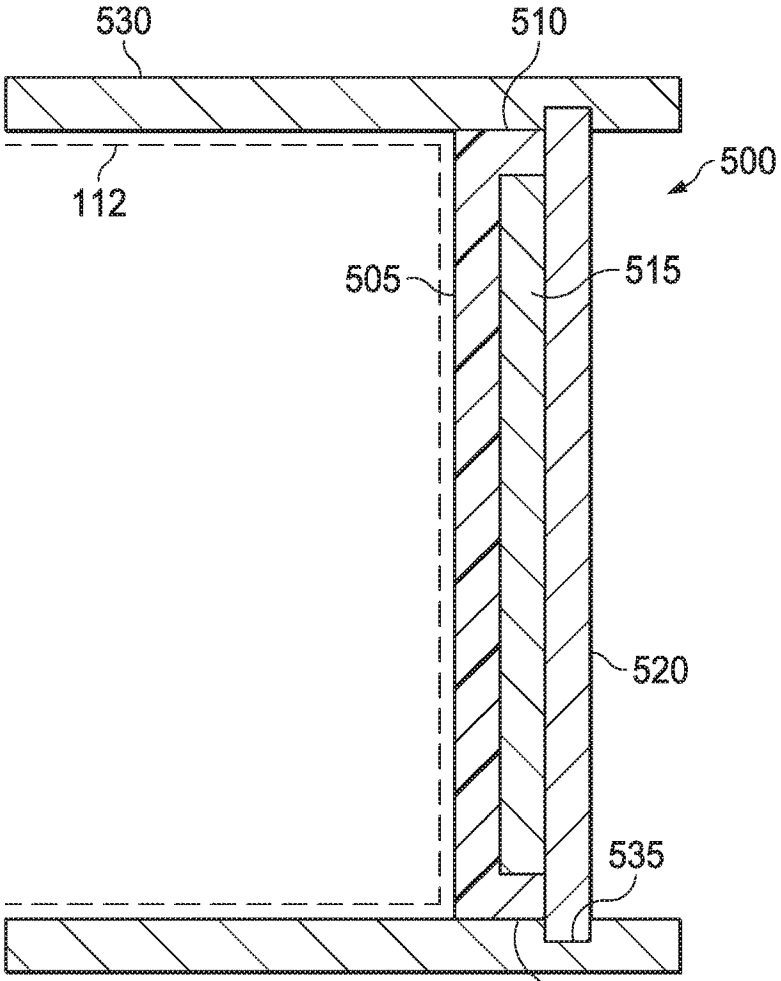
Figure 4:
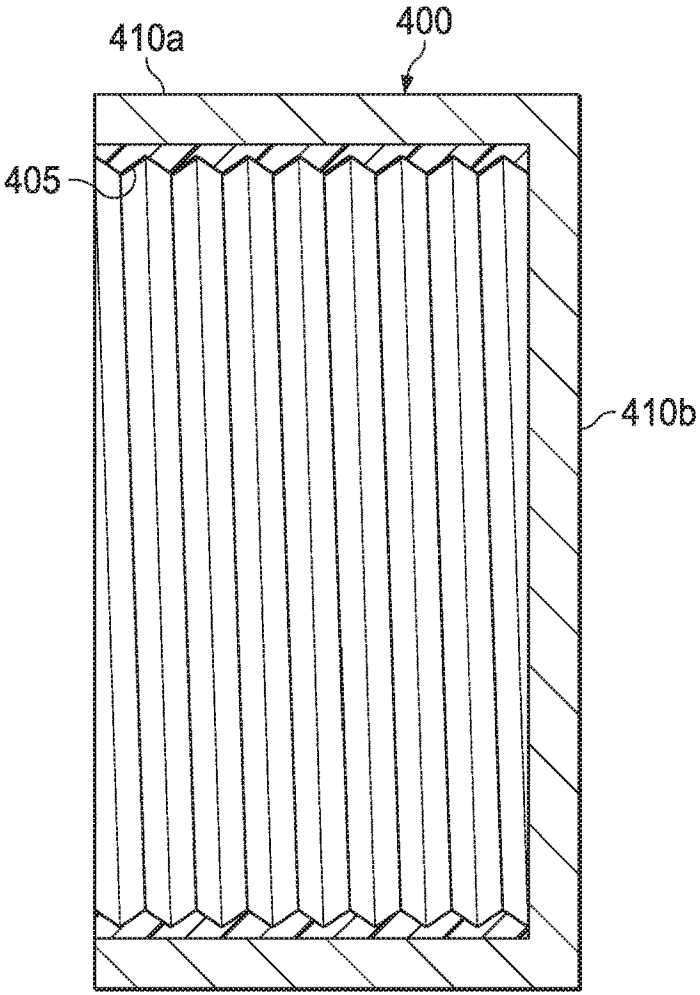
Figure 6A:
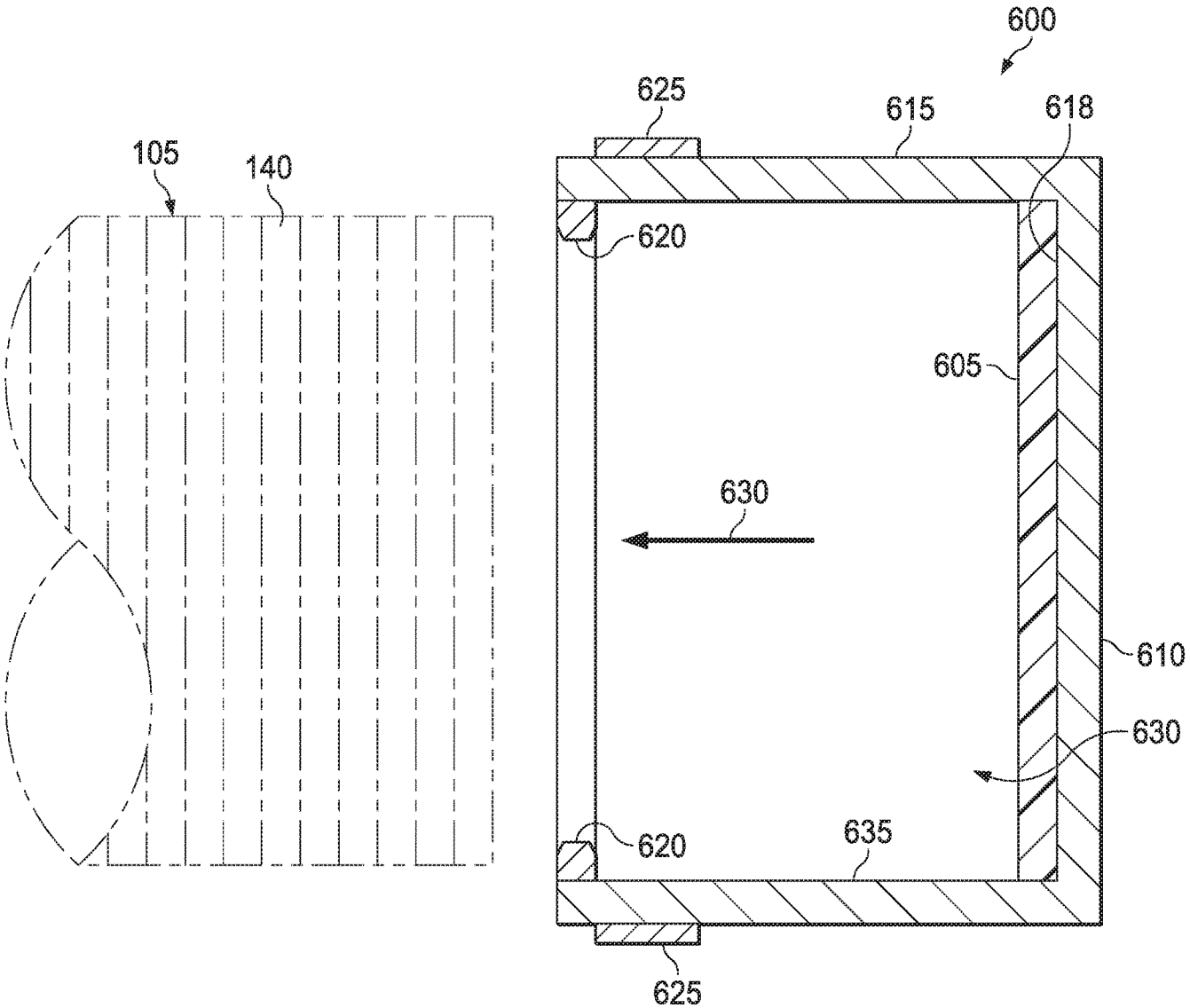
Figure 6B:
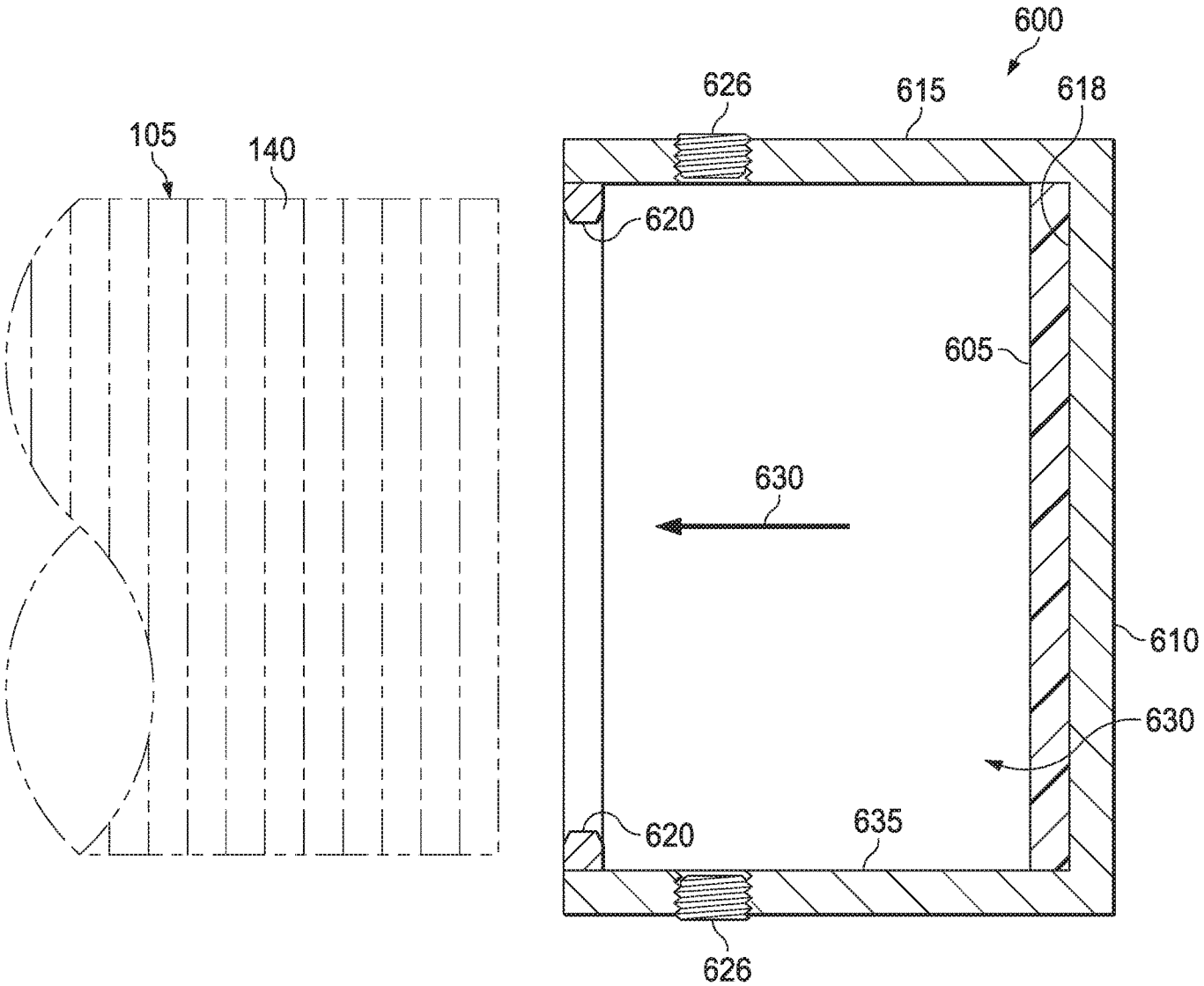
Figure 7A:
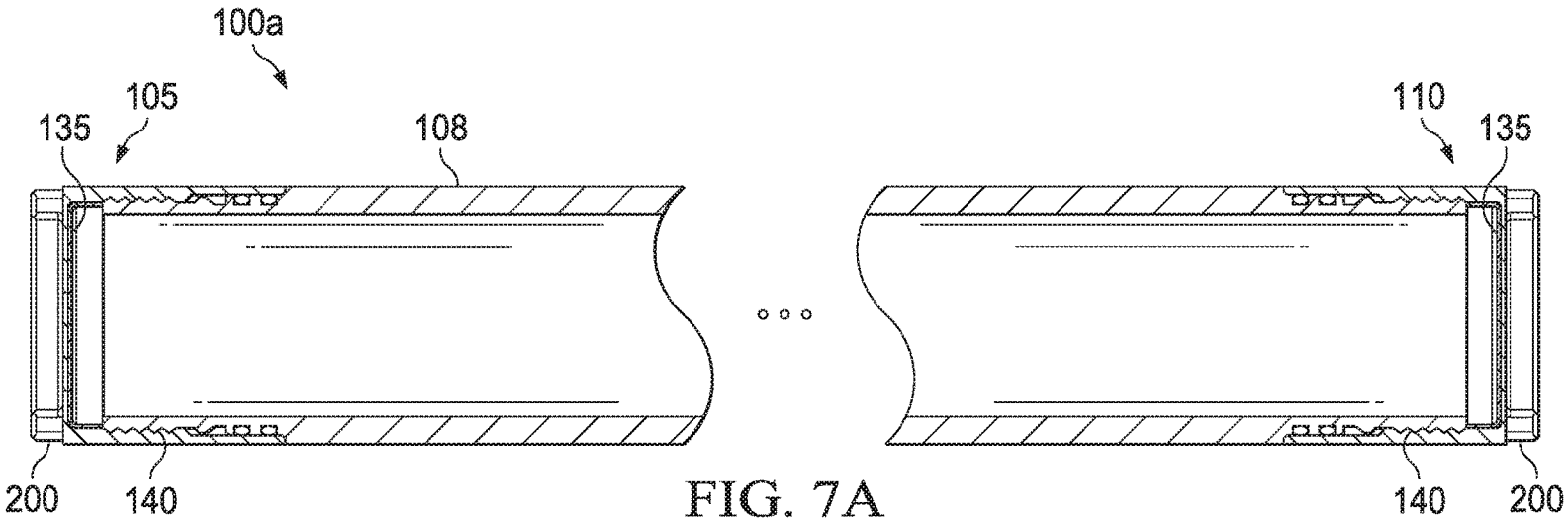
Figure 7B:
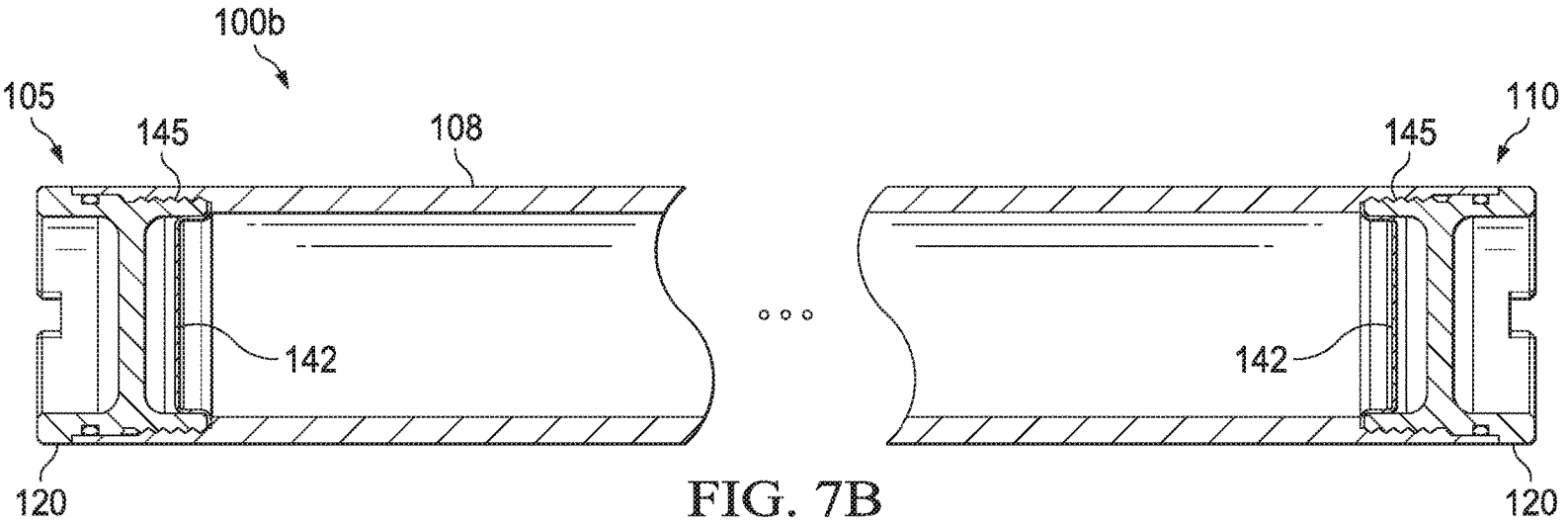

including threads on an outer surface and an O-ring;

FIG. 2D is a cross-sectional view of FIG. 2A, showing alternative additional detail including friction protrusions on an outer surface instead of threads;

FIGS. 2E-2G are illustrations of examples of installation-aid mechanisms for box end protectors according to embodiments of the present disclosure;

FIG. 3A is a perspective view of a pin end protector according to an embodiment of the present disclosure;

FIG. 3B is a cross-sectional view of FIG. 3A;

FIG. 3C is a cross-sectional view of FIG. 3A, showing additional detail including threads on an inner surface;

FIG. 3D is a cross-sectional view of FIG. 3A, showing alternative additional detail including friction protrusions instead of threads on an inner surface;

FIG. 3E-3G are illustrations of examples of installation-aid mechanisms for pin end protectors according to embodiments of the present disclosure;

FIG. 4 is a cross-sectional view of a pin end protector according to an embodiment of the present disclosure;

FIG. 5 is a cross-sectional view of a box protector according to an embodiment of the present disclosure;

FIG. 6A is a cross-sectional view of a pin end protector and a first securing mechanism according to an embodiment of the present disclosure;

FIG. 6B is a cross-sectional view of a pin end protector and a second securing mechanism according to an embodiment of the present disclosure;

FIG. 7A shows pin ends configured at both ends of a jet perforating gun;

FIG. 7B shows box ends configured at both ends of jet perforating gun; and

Figure 8:
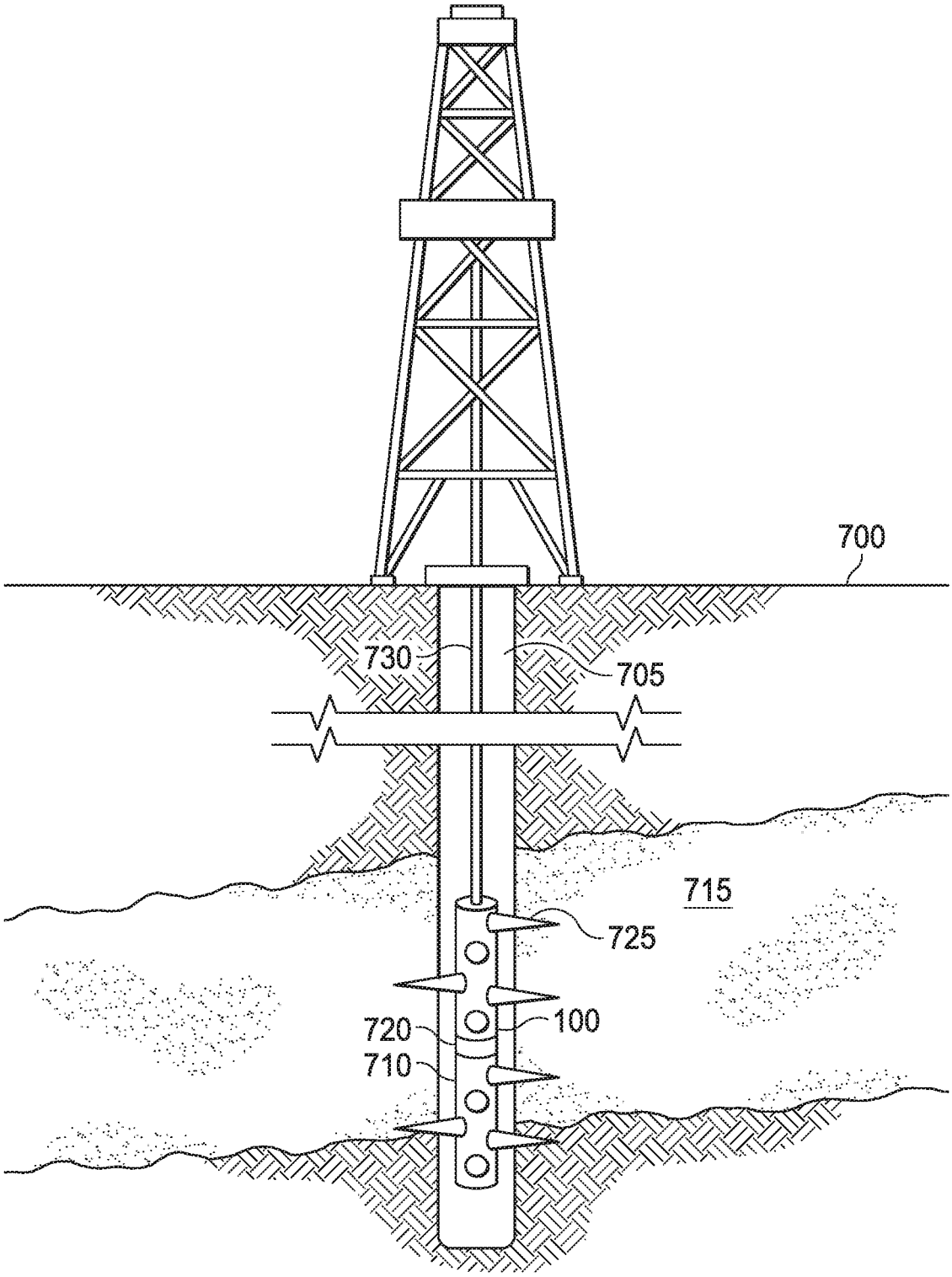

FIG. 8 is an illustration of an example of a well completion using jet perforating guns.

DETAILED DESCRIPTION

While apparatuses, methods and embodiments are discussed in detail below, it should be appreciated that the present disclosure provides many applicable inventive concepts, which can be embodied in a wide variety of specific contexts. The specific embodiments discussed herein are illustrative and do not delimit the scope of the present disclosure. The term "about" herein means within 10% unless context states otherwise. CFR is an abbreviation for Code of Federal Regulation.

Figure 1:
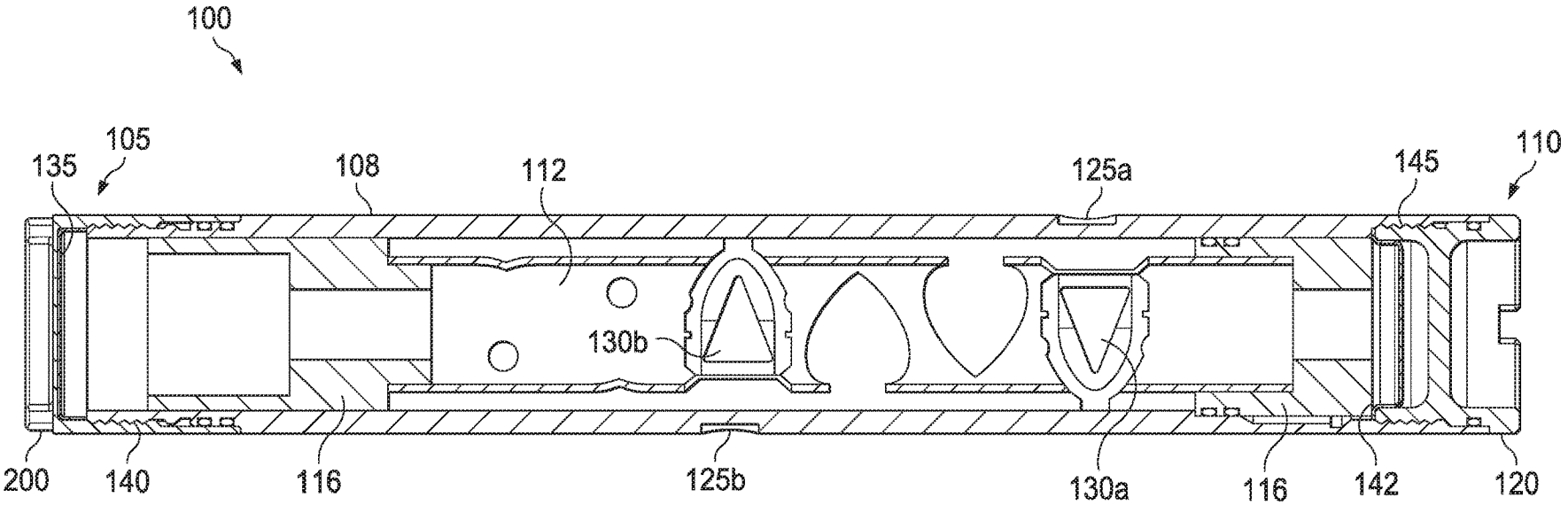
FIG. 1 is a schematic illustration of an example of a jet perforating gun with end protectors according to an embodiment of the present disclosure.

Referring initially to FIG. 1, the jet perforating gun 100 comprises a generally elongated cylindrical tube having a body with a first end 105, known as a pin end, and a second end 110, known as a box end, and comprising an outer housing 108. Alternatively, the jet perforating gun 100 can be configured with a pin end at both the first end 105 and second end 110, or box ends at both the first end 105 and second end 110, as shown in FIGS. 7A and 7B. A pin end has threads 140 configured about the outer circumference of the jet perforating gun end. A box end has threads 145 configured on an inner circumferential surface of a jet perforating gun end. The jet perforating gun 100 includes a charge tube assembly 112 that comprises a plurality of charge tube centralizers 116 to assist in locating the charge tube assembly 112 within the outer housing 108. The charge tube assembly 112 may include one or more shaped charges 130*a*, 130*b*. The shaped charges 130A, 130B are shown aligned with respective scallops 125*a*, 125*b*. Scallops 125*a*, 125*b* are recesses in the outer housing 108 adjacent to the shaped charges 130A, 130B. Upon shape charge detonation during well completion, the profile of scallops 125*a*, 125*b* reduces external burrs created as perforating jets exit the outer housing 108, thereby reducing the risk of hang-up or damage as the jet perforating gun 100 is retrieved from a well bore.

At first end 105, a pin end protector 200 is shown covering end 105 thereby preventing dust and water vapor from entering the interior of the jet perforating gun 100 through an opening at first end 105. Threads 140 configured circumferentially at first end 105 around the outer surface of the outer housing 108 are configured to receive the pin end protector 200 thereabout. A metallic component or metallic compound component such as metal insert 135 is configured as part of the pin end protector 200 to meet governmental standards, as discussed in more detail below.

At second end 110, a box end protector 120 is shown inserted into and within an opening at second end 110 within the outer housing 108 of the jet perforating gun 100 thereby preventing dust and water vapor from entering the interior of the jet perforating gun 100 at the second end 110. Threads 145 configured circumferentially at second end 110 about the inner surface of the outer housing 108 are configured to receive the box end protector 120. A metallic component or metallic compound component such as metal insert 142 is configured as part of the box end protector 120 to meet governmental standards, as discussed in more detail below.

Pin end protector 200 and box end protector 120 may be constructed of different sizes to fit in a wide range of different sized jet perforating guns 100. That is, the circumference of pin end protector 200 and box end protector 120 may vary in embodiments and a particular size selected from a range of circumferences from about 1 inch to about 11 inches to mate with a jet perforating gun 100 of a particular sized circumference.

Referring to FIGS. 2A-2D, a box end protector 120 comprises a circular body 122 and a metal insert 142. The circular body 122 may have a tubular shape. The body may comprise a polymer or a compound used in making different plastics, such as, e.g., polyethylene. The body 122 may be impact resistant from about 40° C. to about 90° C. In some embodiments, the body 122 may have a melting point from about 150° F. to about 250° F., but may vary depending on the specific compound employed. In some embodiments the material of the body 122 may be selected so that a melting temperature is in a range of about 200° F. to about 250° F. Further, a polymer body 122 provides a lower cost component as compared with a traditional metal box end protector.

The circular body 122 includes a central wall 170 configured to separate a first concave portion 160 at a first end of the circular body 122 and a second concave portion 165 at a second end of the circular body 122. The first concave portion 160 being defined by a first circular wall 121 extending outwardly from the wall 170 that also forms a floor of the concave portion 160. The second concave portion 165 being defined by a second circular wall 175 extending outwardly from the wall 170, opposite a direction of first circular wall 121, the wall 170 also forms a floor of the concave portion 165. The circular body 122, including first circular wall 121 and second circular wall 175, may have an outer circumference sized to fit within second end 110 of the jet perforating guns 100. The first circular wall 121 may be configured with an installation-aid mechanism 155 such as one or more notches, slots, holes, slits, ridges, valleys, which may be configured to permit a tool to be temporarily connected to turn the box end protector 120 onto, or off of, the jet perforating gun 100. The installation-aid mechanism 155 may also comprise one or more protrusions or recess features to permit tool interconnectivity, or manual turning, of box end protector 120.

Metal insert 142 is configured in size to mate with the second circular wall 175. Metal insert 142 is circular in shape and has a circular area substantially sufficient to separate, cover, or block the circular body 122 from the interior chambers, including the charge tube assembly 112, of the jet perforating gun 100. The circular area is substantially sufficient to separate, cover, or block the circular body 122 from the interior chambers to prevent moisture, gases, dust or other environmental factors from entering the interior chambers. Metal insert 142 may be formed to have a concave shape with a circular wall 195 extending from the floor 146 of the concave shape, the circular wall 195 being of sufficient circumferential size to permit the metal insert 142 to be held in place by friction with the inner surface 168 of the second circular wall 175. A lip 147 formed in the circular wall 195 may curve 169 outwardly around a terminal edge of the circular wall 195 towards threads 145 of the outer housing 108, the threads 145 being configured circumferentially at second end 110 about the inner surface of the outer housing 108.

An adhesive 172 may be applied to aid in holding the metal insert 142 to the inner surface 168 of the second circular wall 175. A securing mechanism such as threads 167 may be configured along the outer surface of the second circular wall 175 to permit engaging corresponding threads 145 of the jet perforating gun 100. Alternatively, instead of threads 167, as shown in FIG. 2D, the securing mechanism may comprise a plurality of protrusions 180 configured along the outer surface of the second circular wall 175 to permit friction holding and retention of the box end protector 120 within the jet perforating gun 100. In the embodiment of FIG. 2D, the box end protector 120 can be pushed into or turned into the jet perforating gun 100. The box end protector 120 can be removed when the jet perforating gun 100 is ready to be lowered into a well bore.

When the box end protector 120 is installed, the metal insert 142 comprising lip 147, wall 195 and floor 146 provides a metallic safety feature as required by US 1 of 49 CFR § 173.62. The metal insert 142 completely isolates the interior of the jet perforating gun 100 having installed charges 130*a*, 130*b* at the second end 110 for transportation from the external environment.

The body 122 comprising a polymer permits an added safety feature. If the interior of the jet perforating gun 100 were to be compromised such as, e.g., be subjected to elevated temperatures due to a fire or other event during transportation, the polymer or similar compound of the body is able to melt, permitting the metal insert 142 to become free, at least in part, opening a passage from the internal areas of the jet perforating gun 100 permitting internal pressures to be released from the second end 110. This melting of body 122, or a portion thereof, causing freeing of the metal insert 142 may be sufficient to prevent an inadvertent detonation of the charges 130*a*, 130*b*.

In some embodiment, a low melting temperature alloy or a eutectic alloy may be used as all, or part of, the metal insert 142 of the box end protector 120. The alloy may comprise any or all of the following elements, in any combination: bismuth, lead, tin, zinc, silver, cadmium, stainless steel, or other metals, with the alloy having a melting temperature between 150° F. and 800° F. Glass or ceramics may also be used in place of metal along with other metals having eutectic properties. In some embodiments, alloy of the metal insert 142 may have a melting temperature between a range of about 200° F. and about 700° F. In other embodiments, alloy of the metal insert 142 may have a melting temperature between a range of about 250° F. and about 600° F. In still other embodiments, alloy of the metal insert 142 may have a melting temperature between a range of about 300° F. and about 650° F.

As shown in FIGS. 2B and 2C, the body 122 may have a portion 180 of the first circular wall 121 that has a circumference larger than the circumference of the wall 170. Moreover, portion 172 of the first circular wall may have a circumference greater than a circumference of second circular wall 175. A circumferential channel 185 may be configured about the outer surface 172 of the first circular wall 121 and configured to accept an O-ring 150. The O-ring is for providing a seal with the inner wall of the outer housing 108 when the box end protector 120 is inserted into the opening at second end 110 to prevent moisture and dust from entering the jet perforating gun 100. The O-ring 150 may contact and seal against threads 145.

FIGS. 2E-2G are illustrations of examples of installation-aid mechanisms for a box end protector. First circular wall 121 may be configured with an installation-aid mechanism such as one or more holes 190, one or more slits 191 or, one or more raised protrusions 192. A tool may be used in conjunction with the installation-aid mechanisms for turning the box end protector in or out of a jet perforating gun. In some applications, circular wall 121 may not be configured with any installation-aid mechanism.

Referring now to FIGS. 3A-3D, a pin end protector 200 is shown having a first circular wall 210 extending from central wall 235 forming a cavity 260 therewithin at a first end 221 of the pin end connector 222. Pin end protector 200 may have a generally tubular shape. An installation-aid mechanism 255 such as one or more notches, slots, holes, slits, ridges, valleys, may be configured into the first circular wall 210 to permit a tool to be inserted therein to turn the pin end protector 200 onto, or off of, the jet perforating gun 100 at end 105. The installation-aid mechanism 255 may also comprise one or more protrusions or recess features to permit tool interconnectivity, or manual turning, of pin end connector 200.

A second circular wall 223, extending from the wall 235 in a direction opposite a direction of first wall 210, defines a hollowed cavity 227 therewithin at a second end 222 of the pin end protector 200. The cavity 227 is delineated by inner surface 228 of the second circular wall 223. The second circular wall 223 may have first portion 215, a second portion 220 and a third portion 226 each having a different wall thickness and hence different inner circumferences. The first portion 215 is configured thinner than the second portion 220, and the second portion 220 configured thinner than the third portion 226. As shown in FIGS. 3C and 3D the second portion 220 may have a securing mechanism such as threads 225 or a plurality of protrusions 226 configured on the inner surface of the second portion 220 as part of the second portion and same material for attaching the pin end protector 200 to the jet perforating gun 100 at end 105. The securing mechanism such as threads 225 or the plurality of protrusions 226 may contact threads 140 of the jet perforating gun 100 outer surface at end 105 for holding the pin end connector 200 onto the jet perforating gun 100.

A metal insert 205 having a flat surface area about the same as a radial cross-sectional area defined by inner surface 228 is configured to be positioned proximate or against wall 235 at surface 230. The metal insert 205 may be configured with a lip 240 that also friction fits against inner surface 228. When the pin end protector 200 is installed, the metal insert 205 provides a metallic safety feature as required by US 1 of 49 CFR § 173.62. The metal insert 205 completely isolates the interior of the jet perforating gun 100 having installed charges 130*a*, 130*b*, at the first end 105 for transportation.

The first circular wall 210, the second circular wall 223 including the securing mechanism such as threads 225 or protrusions 226, and the wall 235, comprise a polymer or a compound used in making different plastics, such as, e.g., polyethylene. The first circular wall 210, the second circular wall 223, the wall 235 may be impact resistant from about −40° C. to about 90° C. In some embodiments, the first circular wall 210, the second circular wall 223 and the wall 235 may have a melting point from about 150° F. to about 250° F., but may vary depending on specific compound employed. In some embodiments, the material of the first circular wall 210, the second circular wall 223 and the wall 235 may be selected so that a melting temperature is in a range of about 200° F. to about 250° F. Further, the first circular wall 210, the second circular wall 223 and the wall 235 comprising a polymer or related compound provides for a lower cost component as compared with a traditional metal pin end protector.

As a safety feature, similar to the safety feature aspect of the box end protector 120, if the interior of the jet perforating gun 100 were to be compromised such as, e.g., be subjected to elevated temperatures due to a fire or other event during transportation, the polymer or similar compound comprising at least one of the first circular wall 210, the second circular wall 223, including securing mechanism such as threads 225 or protrusions 226, and the wall 235 will melt permitting the metal insert 205 to become free, at least in part, opening a passage from the internal areas of the jet perforating gun 100 permitting internal pressures to be released from the first end 105. Any melting causing freeing of the metal insert 205 may be sufficient to prevent an inadvertent detonation of the charges 130*a*, 130*b*.

In embodiments, a low melting temperature alloy or a eutectic alloy may be used as all, or part of, the metal insert 205 of the pin end protector 200. The alloy may comprise any or all of the following elements, alone or in any combination: bismuth, lead, tin, silver, stainless steel, zinc, cadmium, or other metals, with the alloy having a melting temperature between 150° F. and 800° F. Glass or ceramics may also be used in place of metal along with other metals having eutectic properties.

In some embodiments, alloy of the metal insert 205 may have a melting temperature between a range of about 200° F. and about 700° F. In other embodiments, alloy of the metal insert 205 may have a melting temperature between a range of about 250° F. and about 600° F. In still other embodiments, alloy of the metal insert 205 may have a melting temperature between a range of about 300° F. and about 650° F.

FIGS. 3E-3G are illustrations of examples of installation-aid mechanisms for a pin end protector. Circular wall 210 may be configured with an installation-aid mechanism such as one or more holes 290, one or more slits 291 or one or more raised protrusions 292. A tool may be used in conjunction with the installation-aid mechanisms for turning the pin end protector in or out of a jet perforating gun. In some embodiments, circular wall 210 may not be configured with any installation-aid mechanism.

FIG. 4 is a cross-sectional view of a pin end protector 400 according to an embodiment of the present disclosure. Alternatively, the pin end connector of FIG. 4 may have the same general shape as FIGS. 3A and 3B. The pin end protector 400 may be configured with a circular wall 410*a* and an end 410*b* enclosing a cavity therewithin similar to cavity 227 of FIG. 3B. End 410*b* may also be configured with a similar shape as wall 210 including notches or slits 255 of FIG. 3B. However, the circular wall 410*a* and end 410*b* comprise a metal, metal compound or metal alloy. In some embodiments, the circular wall 410*a* and end 410*b* comprise a metal alloy having a low melting temperature alloy or a eutectic alloy. The metal or alloy may comprise any or all of the following elements, in any combination: bismuth, lead, tin, zinc, silver, cadmium, stainless steel, or other metals, with the alloy having a melting temperature between 150° F. and 800° F. Glass or ceramics may also be used in place of metal along with other metals having eutectic properties. In some embodiments, the alloy may have a melting temperature between a range of about 200° F. and about 700° F. In other embodiments, alloy may have a melting temperature between a range of about 250° F. and about 600° F. In still other embodiments, the alloy may have a melting temperature between a range of about 300° F. and about 650° F.

The pin end protector 400 includes a securing mechanism such as protrusions or threads 405 configured on or about the inner circumference of circular wall 410*a*. The securing mechanism such as protrusions or threads 405 comprise a polymer or a compound used in making different plastics, such as, e.g., polyethylene. The securing mechanism permits attaching and removal of the pin end protector 400 to or from the jet perforating gun 100 at end 105. However, the securing mechanism such as protrusions or threads 405 provides an added safety feature. If the interior of the jet perforating gun 100 were to be compromised such as, e.g., be subjected to elevated temperatures due to a fire or other event during transportation, the polymer or similar compound of the securing mechanism is able to melt, opening a passage from the internal areas of the jet perforating gun 100 along circular wall 410*a* permitting internal pressures to be released from the first end 105. This melting of the securing mechanism such as protrusions or threads 405 may be sufficient to prevent an inadvertent detonation of the charges 130*a*, 130*b*, thereby providing with improved safety performance. The metal or metal alloy of circular wall 410*a* and end 410*b* securing mechanism 405 provides a metallic safety feature as required by US 1 of 49 CFR § 173.62, but with improved safety performance.

Referring to FIG. 5, a box protector 500 is provided for certain types of jet perforating guns. A wall 530 of a jet perforating gun is configured with a channel 535 about the inner surface of the wall 530 proximate a box end of a jet perforating gun. A charge tube assembly 112 is shown configured within the jet perforating gun. A securing mechanism such as polymer insert 505 is configured to hold a metal insert such as metal disk 515 with a portion 510 of the polymer insert 505 surrounding the outer edges of the metal disk 515, and about the outer circumference of the metal disk, and to hold the metal disk 515 vertically in relation to wall 530. The polymer insert 505 and held metal disk 515 assembly is inserted into the jet perforating gun so that the polymer insert 510 is positioned proximate or against the charge tube assembly 112. A snap ring 520 is inserted into the channel thereby holding the polymer insert 505 and held metal disk 515 assembly securely against the charge tube assembly 112. The snap ring 520 is not a solid component such that passage of gases therethrough is permitted. The snap ring 520 may be configured with holes in the center or other locations. The snap ring 520 may comprise a metal. Metal disk 515 may be an alloy or eutectic alloy. The alloy may comprise any or all of the following elements, in any combination: bismuth, lead, tin, silver, zinc, cadmium, or other metals, with the alloy having a melting temperature between 150° F. and 800° F. Glass or ceramics may also be used in place of metal along with other metals having eutectic properties. In some embodiments, the alloy may have a melting temperature between a range of about 200° F. and about 700° F. In other embodiments, the alloy may have a melting temperature between a range of about 250° F. and about 600° F. In still other embodiments, the alloy may have a melting temperature between a range of about 300° F. and about 650° F. The metal disk 515 may comprise a metal, metal compound or metal alloy.

The polymer insert 505 may be impact resistant from about −40° C. to about 90° C. In some embodiments, the polymer insert 505 may have a melting point from about 150° F. to about 250° F., but may vary depending on specific polymer employed. In some embodiments the polymer insert 505 may be selected so that a melting temperature is in a range of about 200° F. to about 250° F. Further, the polymer insert 505, in combination with a metal disk 515 and snap ring 520, provide a lower cost solution with improved safety performance as compared with a traditional metal box end protector.

If the interior of the jet perforating gun 100 were to be compromised such as, e.g., be subjected to elevated temperatures due to a fire or other event during transportation, the polymer insert 505 will melt, likely at or near portion 510 of the polymer insert 505, but may be any portion of the polymer insert 505, thereby opening a passage from the internal areas of the jet perforating gun past or through the snap ring 520 permitting internal pressures to be released from the first end 105. This melting of the polymer insert 505 may be sufficient to prevent an inadvertent detonation of the charges 130*a*, 130*b*. The metal disk 515 provides a metallic safety feature as required by US 1 of 49 CFR § 173.62, and with the polymer insert 505 also provide improved safety performance.

Referring to FIGS. 6A and 6B, a pin end protector 600 is shown having a polymer circular wall 615 extending from wall 610 forming a cavity 630 sized to be inserted 630 about a pin end of a jet perforating gun 100, such as end 105. Threads 140 are configured at the pin end of the perforating gun. A polymer securing mechanism 620 which can be protrusions or threads are formed on inner surface 635 to hold the pin end connector 600 onto the pin end of the jet perforating gun, while permitting the pin end protector to be easily removed.

Pin end protector 600 may also be configured in a similar shape as pin end protector 200, along with polymer features such as, e.g., one or more notches or slits 255 that may be configured into the first wall 210, the second circular wall 223, which may have first portion 215, a second portion 220 and a third portion 226 each having a different wall thickness.

A fastening mechanism 625 provides additional securing of the pin end protector 600 to the pin end of jet perforating gun 100. The fastening mechanism 625 may comprise a worm clamp arranged about the circumference of the pin end protector 600 for easy tightening or release. Alternatively, as shown in FIG. 6B, the fastening mechanism 625 may comprise one or more set screws 626 arranged about the circumference of the pin end protector 600 for easy tightening or release. In some embodiments, only the fastening mechanism 625 is needed to secure the pin end protector 600 to the jet perforating gun, without need for polymer securing mechanism 620.

Metal insert 605 is configured proximate or adjacent base 618 of the cavity 630 and may be molded into the wall 610 to secure it in place, or alternatively, held in place by an adhesive inserted along base 618. Metal insert 605 has sufficient surface area to substantially cover or block the pin end of jet perforating gun 100. Metal insert 605 may be a metal, eutectic metal, metal compound, or a metal alloy comprising any or all of the following elements, in any combination: bismuth, lead, tin, zinc, stainless steel, silver, cadmium, with the metal or alloy having a melting temperature between 150° F. and 800° F.

In some embodiments, alloy of the metal insert 142 may have a melting temperature between a range of about 200°

F. and about 700° F. In other embodiments, alloy of the metal insert 605 may have a melting temperature between a range of about 250° F. and about 600° F. In still other embodiments, alloy of the metal insert 605 may have a melting temperature between a range of about 300° F. and about 650° F.

The polymer circular wall 615 and polymer securing mechanism 620 may be impact resistant from about −40° C. to about 90° C. In some embodiments, polymer circular wall 615 and polymer securing mechanism 620 may have a melting point from about 150° F. to about 250° F., but may vary depending on specific polymer employed. In some embodiments the polymer circular wall 615 and polymer securing mechanism 620 may be selected so that a melting temperature is in a range of about 200° F. to about 250° F. Further, the polymer circular wall 615 and polymer securing mechanism 620 in combination with a metal insert 605 provide a lower cost solution for a metallic safety feature as required by US 1 of 49 CFR § 173.62 with improved safety performance as compared with a traditional metal pin end protector.

FIG. 7A shows pin ends configured at both ends of jet perforating gun 100*a*. Pin end protectors of FIGS. 3A-3D, 4, 6A and 6B can be used on both ends of jet perforating gun 100*a*. FIG. 7B shows box ends configured at both ends of jet perforating gun 100*b*. Box end protectors of FIGS. 2A-2*d* and 5 can be used on each of jet perforating gun 100*b*.

Referring to FIG. 8, in this illustrative example, a string 710 of j et perorating guns 100 is shown lowered 730 into well 705 at a drilling site 700. Any box end protectors and pin end protectors have already been removed from jet perorating guns 100 after transport of the jet perorating guns 100 with pre-loaded charges to the drilling site 700. Coupler 720 is shown connecting a first jet perorating gun with a second jet perorating gun. Coupler 720 accepts the pin end from the first jet perorating gun 100 and connects to the box end of the second jet perorating gun 100. Upon detonation, the subterranean formation 715 receives the lateral explosive forces 725 to fracture the subterranean formation 715 to promote hydrocarbon flow.

Glass or ceramics may be used in place of the metal inserts or metal disks described herein. The glass or ceramics may also be used in place of only metal, but comprising a compound of glass or ceramic along with other metals that have low melting properties or other eutectic properties to provide a metallic compound. Low melting properties would be a melting temperature between a range of about 200° F. and about 700° F.; about 250° F. and about 600° F.; or between a range of about 300° F. and about 650° F.

The metal inserts or metal disks described herein may be stamped, poured, machined, or cast. The metal inserts or metal disks can be glued, melted, chemically deposited on the polymer substrate, or plastic welded in place in the plastic or polymer thread end protectors. In some embodiments, the metal inserts or disks may be circular or parabolic in shape to radially block an opening proximate an end of a perforating gun.

The end protectors configured according to principles herein protect the threads of the perforating gun, are self-venting, protect internal components of a perforating gun from external contaminants such as dust and water, and meet regulatory requirements. The polymer portions of the end protectors will melt as temperatures might rise in case of a deflagration occurring. This prevents build-up of pressures in the perforating gun. The end protectors are easy to install or remove.

In aspects, the principles of the disclosure include:

Clause 1: An end protector for a well perforating gun, comprising:

a polymer securing mechanism configured to be in contact with a circumferential wall of a perforating gun; and a metallic component or a metallic compound component coupled to the polymer securing mechanism and sized to block an opening of an end of the perforating gun for protecting internal components of the perforating gun from external contaminants.

Clause 2: The end protector of clause 1, wherein the polymer securing mechanism is configured to contact threads configured around the circumferential wall of the perforating gun.

Clause 3: The end protector of clauses 1 or 2, wherein the polymer securing mechanism comprises threads or a plurality of protrusions to engage with the circumferential wall of the perforating gun, the threads or a plurality of protrusions being meltable for permitting venting of an interior of the perforating gun in case of a deflagration to prevent or reduce build-up of pressures in the perforating gun.

Clause 4: The end protector of clauses 1, 2 or 3, wherein the circumferential wall comprises an exterior circular wall, and the end protector comprises a pin end protector.

Clause 5: The end protector of clauses 1, 2 or 3 wherein the circumferential wall comprises an interior circular wall, and the end protector comprises a box end protector.

Clause 6: The end protector of any one of clauses 1-5, wherein the metallic compound component comprises glass or ceramic, in combination with a metal having a melting temperature being between 150° F. and 800° F.

Clause 7: The end protector of any one of clauses 1-6, further comprising an adhesive to hold the metallic component or metallic compound component to the polymer securing mechanism.

Clause 8: The end protector of any one of clauses 1-7, wherein the metallic component or the metallic compound component comprises an eutectic alloy or low temperature melting metal, the metallic component or metallic compound component having a melting point in a range of between 150° F. and 800° F.

Clause 9: The end protector of one of clauses 1-8, wherein the metallic component or the metallic compound component comprises one or more of, in any combination: bismuth, lead, tin, zinc, silver, cadmium, or stainless steel.

Clause 10: The end protector of any one of clauses 1-9, wherein the metallic component or the metallic compound component comprises a metal disk, wherein the polymer securing mechanism surrounds the metal disk, further comprising a snap ring configured to snap into a channel of the perforating gun for holding the polymer securing mechanism and the metal disk in the perforating gun.

Clause 11: The end protector of any one of clauses 1-10, wherein the metal disk, the metallic component or the metallic compound is stamped, poured, machined or cast.

Clause 12: The end protector of any one of clauses 1-9, wherein the metal component or the metallic compound component is glued, melted or chemically deposited on the polymer securing mechanism.

Clause 13: The end protector any one of clauses 1-12, further comprising at least one installation-aid mechanism configured proximate an end the polymer securing mechanism for accepting a tool for assisting in inserting or removing the end protector at an end of the perforating gun, wherein the installation-aid mechanism comprises at least one slit, at least one notch, at least one ridge, at least one valley or at least one hole.

Clause 14: The end protector of any one of clauses 1-13, wherein polymer securing mechanism comprises a circular body having a first end and a second end and configured to engage with the circumferential wall of the perforating gun, the circular body having a central polymer wall configured to separate a first concave portion and a second concave portion, the first concave portion formed by a first circular polymer wall extending from the central wall, and the second concave portion formed by a second circular polymer wall extending from the central polymer wall, the metallic component or the metallic compound component comprises an insert and is held in place across one of the concave portions proximate to and parallel with the central polymer wall.

Clause 15: A method of providing an end protector for a well perforating gun, comprising:

forming a polymer securing mechanism configured to contact or attach with a circular wall of a perforating gun; and coupling a metallic component or a metallic compound component to the polymer securing mechanism, the metallic component or metallic compound component sized to block an opening proximate an end of the perforating gun for protecting internal components of perforating gun from external contaminants.

Clause 16: The method of clause 15, wherein the forming of the polymer securing mechanism comprises configuring threads or a plurality of protrusions to engage with threads configured around a circumference of the curricular wall, the threads or the plurality of protrusions of the polymer securing mechanism being meltable for permitting venting of an interior of the perforating gun in case of a deflagration to prevent or reduce build-up of pressures in the perforating gun.

Clause 17: The method of clauses 15 or 16, wherein the metallic compound component comprises glass or ceramic in combination with a metal having a melting temperature being between 150° F. and 800° F.

Clause 18: The method of clauses 15, 16 or 17, wherein the metallic component or metallic compound component comprises an eutectic alloy or low temperature melting metal, having a melting point in a range of between 150° F. and 800° F.

Clause 19: The method of any one of clauses 15-18, further comprising configuring at least one installation-aid mechanism at an end of the polymer securing mechanism for accepting a tool to assist in inserting or removing the end protector at an end of the perforating gun.

Clause 20: The method of clause 19, wherein the installation-aid mechanism comprises at least one slit, at least one notch, at least one ridge, at least one valley or at least one hole.

The embodiments set forth herein are merely illustrative and do not limit the scope of the disclosure. It will be appreciated that many other modifications and improvements to the disclosure herein may be made without departing from the scope of the disclosure.

We claim:

1. An end protector for a well perforating gun, comprising:

polymer securing mechanism configured to be in contact with a circumferential wall of a perforating gun; and a metallic component or a metallic compound component coupled to the polymer securing mechanism and sized to block an opening of an end of the perforating gun for protecting internal components of perforating gun from external contaminants, wherein the metallic compound component comprises at least one of glass or ceramic, in combination with a metal having a melting temperature being between 150° F. and 800° F., and an eutectic alloy or low temperature melting metal, having a melting point in a range of between 150° F. and 800° F.

2. The end protector of claim 1, wherein the polymer securing mechanism is configured to contact threads configured around the circumferential wall of the perforating gun.

3. The end protector of claim 1, wherein the polymer securing mechanism comprises threads or a plurality of protrusions to engage with the circumferential wall of the perforating gun, the threads or a plurality of protrusions being meltable for permitting venting of an interior of the perforating gun in case of a deflagration to prevent build-up of pressures in the perforating gun.

4. The end protector of claim 1, wherein the circumferential wall comprises an exterior circular wall, and the end protector comprises a pin end protector.

5. The end protector of claim 1, wherein the circumferential wall comprises an interior circular wall, and the end protector comprises a box end protector.

6. The end protector of claim 1, further comprising an adhesive to hold the metallic component or metallic compound component to the polymer securing mechanism.

7. The end protector of claim 1, wherein metallic component or metallic compound component comprises one or more of, in any combination: bismuth, lead, tin, zinc, silver, cadmium, or stainless steel.

8. The end protector of claim 1, wherein the metallic component or metallic compound component comprises a metal disk, wherein the polymer securing mechanism surrounds the metal disk, further comprising a snap ring configured to snap into a channel of the perforating gun for holding the polymer securing mechanism and the metal disk in the perforating gun.

9. The end protector of claim 8, wherein the metal disk, the metallic component or the metallic compound is stamped, poured, machined or cast.

10. The end protector of claim 1, wherein the metal component or metallic compound component is glued, melted or chemically deposited on the polymer securing mechanism.

11. The end protector of claim 1, further comprising at least one installation-aid mechanism configured proximate an end the polymer securing mechanism for accepting a tool for assisting in inserting or removing the end protector at an end of the perforating gun, wherein the installation-aid mechanism comprises at least one slit, at least one notch, at least one ridge, at least one valley or at least one hole.

12. The end protector of claim 1, wherein polymer securing mechanism comprises a circular body having a first end and a second end and configured to engage with a wall of the perforating gun, the circular body having a central polymer wall configured to separate a first concave portion and a second concave portion, the first concave portion formed by a first circular polymer wall extending from the central wall, and the second concave portion formed by a second circular polymer wall extending from the central polymer wall, the a metallic component or metallic compound component comprises an insert and is held in place across the one of the concave portions proximate the central polymer wall.

13. A method of providing an end protector for a well perforating gun, comprising:

coupling a metallic component or a metallic compound component to a polymer securing mechanism, the metallic component or metallic compound component sized to block an opening proximate an end of the perforating gun for protecting internal components of perforating gun from external contaminants; and contacting or attaching the polymer securing mechanism with a circular wall of a perforating gun, wherein the metallic compound component comprises at least one of glass or ceramic, in combination with a metal having a melting temperature being between 150° F. and 800° F., and an eutectic alloy or low temperature melting metal, having a melting point in a range of between 150° F. and 800° F.

14. The method of claim 13, wherein the polymer securing mechanism comprises threads or a plurality of protrusions to engage with threads configured around the circumference of the circular wall during the contacting or attaching step, the threads or the plurality of protrusions of the polymer securing mechanism being meltable for permitting venting of an interior of the perforating gun in case of a deflagration to prevent build-up of pressures in the perforating gun.

15. The method of claim 13, further comprising configuring at least one installation-aid mechanism at an end of the polymer securing mechanism for accepting a tool to assist in inserting or removing the end protector at an end of the perforating gun.

16. The method of claim 15, wherein the installation-aid mechanism comprises at least one slit, at least one notch, at least one ridge, at least one valley or at least one hole.

* * * * *